US005696479A

United States Patent [19]

Oughton et al.

[11] Patent Number: 5,696,479

[45] Date of Patent: Dec. 9, 1997

[54] ENERGY REGULATORS

[75] Inventors: Dominic Michael Anthony Oughton, Hyde, England; John Crawshaw Taylor, Balladoole, Isle of Man

[73] Assignee: Strix Limited, Ronaldsway, Isle of Man

[21] Appl. No.: 351,239

[22] PCT Filed: Jun. 8, 1993

[86] PCT No.: PCT/GB93/01209

§ 371 Date: Jan. 18, 1995

§ 102(e) Date: Jan. 18, 1995

[87] PCT Pub. No.: WO93/26027

PCT Pub. Date: Dec. 23, 1993

[30] Foreign Application Priority Data

Jun. 8, 1992 [GB] United Kingdom ..... 9212069
May 12, 1993 [GB] United Kingdom ..... 9309788

[51] Int. Cl.[6] ..... H01H 37/52

[52] U.S. Cl. ..... 337/333; 337/342; 337/380

[58] Field of Search ..... 337/36, 42, 342, 337/348, 324, 377, 333, 337, 380

[56] References Cited

U.S. PATENT DOCUMENTS 2,623,138 12/1952 Kumler .
2,906,839 9/1959 Ashe et al. .
4,839,626 6/1989 Hollweck ..... 337/377

FOREIGN PATENT DOCUMENTS 1 000 093 1/1957 Germany .
1 615 670 8/1970 Germany .
1 946 068 3/1971 Germany .
1 391 192 4/1975 United Kingdom .

*Primary Examiner*—Leo P. Picard
*Assistant Examiner*—Jayprakash N. Gandhi
*Attorney, Agent, or Firm*—Burns, Doane, Swecker & Mathis, L.L.P.

[57] ABSTRACT

An energy regulator includes a pivotally mounted, U-shaped bimetallic element, one limb of which acts as an actuator for a microswitch arm, which is pivotally mounted to one end thereof. The other limb acts as a compensating bimetal and has a cam follower that engages a control surface of a control cam. The stressed C spring formed by the microswitch acts to bias the element into a pivotal mount in the housing, to bias the contact arm onto a pivotal seat on the end of the actuator and also generates a moment to bias the cam follower into engagement with its control surface.

48 Claims, 6 Drawing Sheets

FIG.5.
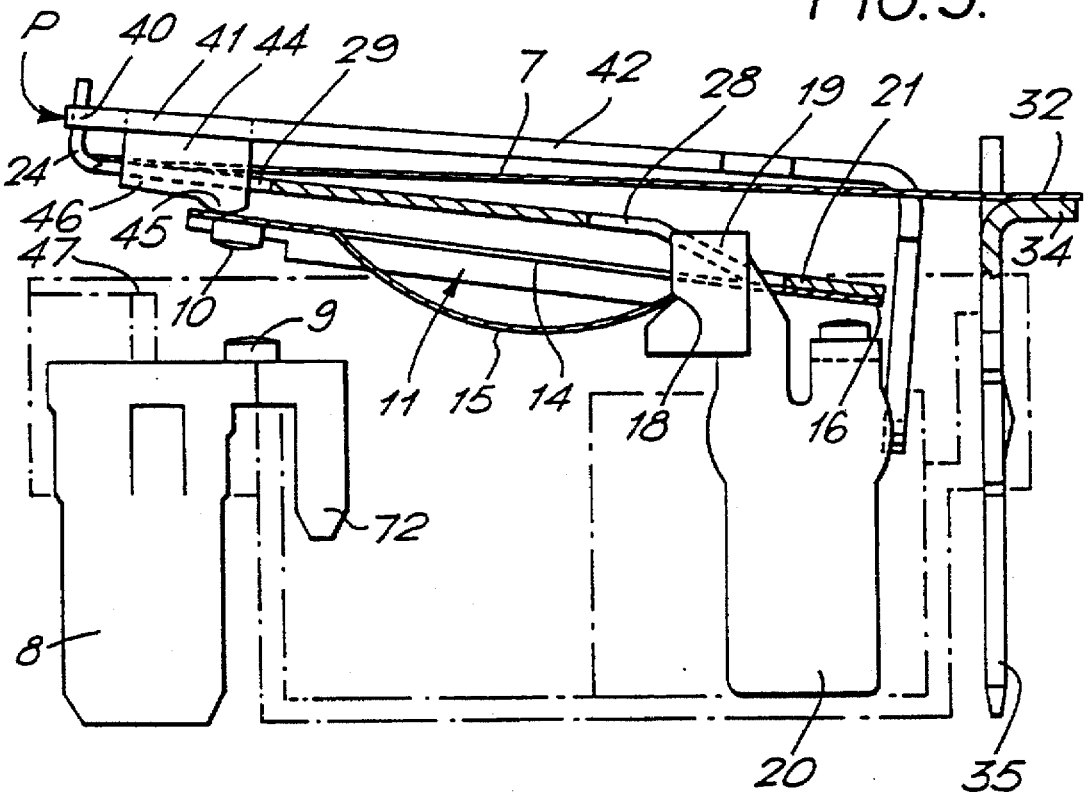
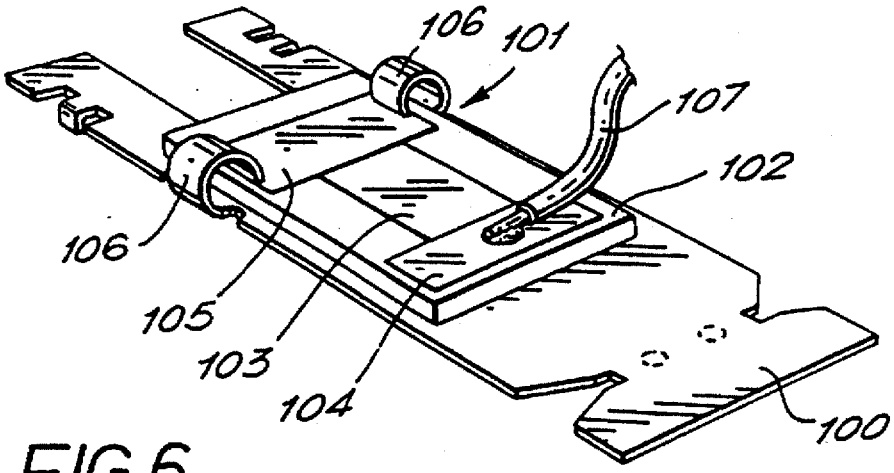
FIG.6.

ENERGY REGULATORS

BACKGROUND OF THE INVENTION

1. Field of the Invention

The present invention relates to energy regulators for controlling the supply of electrical energy to electrical loads such as cooker hot plates or grills.

2. Description of Related Art

Typically, energy regulators comprise a snap-acting microswitch having a set of switch contacts arrangeable in the electrical supply circuit to the electrical load, an actuating member, for example a snap-acting switch contact arm, operatively associated with a bimetallic actuator for operating the switch contacts, and electrically energisable heating means associated with the bimetallic actuator. In such constructions, electrical power is initially supplied to the load and to the heating means which may be connected either in parallel or in series with the load. The heating means heats the bimetallic actuator, causing it to deform to the point where it causes snap-movement of the contact arm to open the switch contacts and interrupt the power supply to both the load and the heating means. The bimetallic actuator then cools and deforms in the opposite direction to the point where the contact arm undergoes reverse snap-action to close the contacts once more, whereupon the cycle recommences. Thus such regulators operate on the principle of supplying power to the load over a proportion of an operating cycle, the proportion being determined typically by the initial position of a free end of the bimetallic actuator which actuates the contact arm, such initial position being settable by control means coupled in use to a user actuated control member e.g. a knob. Such constructions are hereinafter referred to as "energy regulators of the kind described". The bimetallic actuator may, for example, form an integral part of a bimetallic element which further includes an ambient compensating bimetal through which the control means may be coupled to the actuator whereby the initial position of the free end thereof is unaffected by changes in ambient temperature.

In energy regulators of the kind described, it has been standard practice to provide separate mountings for the compensating bimetal and/or the bimetallic actuator and/or the microswitch contact arm and this results in an unnecessarily high number of components. Furthermore, there is often the need for a complicated linkage means for transmitting the actuating movement of the bimetallic actuator to the microswitch. Thus, known arrangements tend to be complicated and relatively costly.

SUMMARY OF THE INVENTION

From a first aspect, the invention provides an energy regulator comprising a bimetallic actuator and a snap-acting microswitch associated therewith, said regulator comprising a switch actuating member carried by a movable portion of the bimetallic actuator.

The actuating member may comprise for example a switch contact arm mounted, at its end remote from the contact, on the free end of the bimetallic actuator.

Viewed from a second aspect the invention provides an energy regulator of the kind described which is characterised in that the end of the switch contact arm remote from the switch contacts is carried by a movable free end of the bimetallic actuator.

Thus, in accordance with the invention, not only does the actuator provide a support for the switch actuating member or contact arm, but the actuating movement is transmitted directly to it. This is a new departure from known energy regulators and leads to a reduction in the number of parts and cost saving. As described below, the end of the switch contact arm or actuating member may be either pivotally or fixedly secured to the movable free end of the actuator.

As is traditional, the microswitch may comprise a spring means which provides an overcentre mechanism whereby the contacts are opened and closed by snap-action action in response to movement of the bimetallic actuator. The bimetallic actuator is mounted in the regulator such that when assembled, the spring means is placed in tension or compression to give the necessary spring biasing force for the contact arm.

The spring means may comprise a C-spring extending between the contact arm and a fixed reaction support. The spring may be separate from or integral with the contact arm and in a preferred embodiment, the contact arm comprises an elongate blade having a U shaped cut out, defining a tongue intermediate two side arms, the tongue being bowed in use to form the C-spring. One end of the blade mounts, or is coupled, to a movable contact while the other end of the blade is mounted to the bimetallic actuator.

In a preferred embodiment, the switch contact arm and the bimetallic actuator are arranged in a generally face to face relationship, such that the actuator overlies the contact arm and is secured thereto at one end. The end of the bimetallic actuator removed from the free end carried by the contact arm is suitably supported such that as said bimetallic actuator is heated and cooled, the free end thereof may deflect in a direction generally perpendicular to the plane in which the contact arm lies to actuate the contact arm.

With the preferred form of contact arm discussed above, the central tongue is prestressed into a C-spring configuration upon assembly of the microswitch by engagement in a notch formed in a fixed support, which projects between the side arms of the contact arm towards the actuation end thereof remote from the contacts. Such actuation end is pivotally or fixedly secured to the bimetallic actuator which acts to hold the tongue in compression in a direction approximately parallel to the general planes in which the contact arm and bimetallic actuator lie. The bimetallic actuator is thereby also held in compression and should be sufficiently rigid to withstand the force of the spring.

As discussed above, the energy regulator comprises control means for adjusting the operating cycle of the microswitch and thereby the energy supplied to the load. Such means preferably comprises a rotatable cam surface operatively coupled to a control member, for example a knob, operated by a user, and a cam follower engaging the cam surface and being coupled to the bimetallic actuator via the compensating bimetal such that as said cam follower is moved by the cam, the ambient position of the free end of the bimetallic actuator is moved to vary the distance through which it must deflect under the heating effect of the heating means to cause the switch contact arm to operate to open the contacts. Preferably the cam follower engages with a surface of the cam which faces towards the control member.

The actuator and compensating bimetal preferably constitute respective limbs of a preferably one piece bimetallic element which is mounted for pivotal movement in response to rotation of the cam. Such an arrangement is well known in general terms. For lower power settings the cam is set such that the free end of the bimetallic actuator has a relatively small distance to travel before the contact arm undergoes snap-action to open the contacts to disable both the load and the actuator heating means. The load and heating means remain disabled until the actuator has cooled sufficiently to cause reverse snap-action of the contact arm whereupon the cycle repeats itself. For higher power settings, the ambient position of the free end of the actuator is adjusted by means of the cam so that it has a greater distance to travel to actuate the contact arm whereby the operating cycle of the switch means is adjusted and, in particular, the proportion of the cycle during which the contacts are closed to energise the load and heating means is increased.

In most known energy regulators, a separate spring is provided for biasing the cam follower into engagement with the cam. In a particularly preferred form of the invention, however, the contact arm spring means by virtue of the mounting of the contact arm to the bimetallic actuator is coupled via the actuator and the compensating bimetal to the cam follower to maintain engagement thereof with the cam. This is particularly advantageous since it obviates the need for a separate biasing means for the cam follower.

In a preferred arrangement, the cam follower forms an integral part of the ambient compensating bimetal. Conveniently, the bimetallic element is generally U-shaped with the compensating bimetal and the bimetallic actuator forming the respective arms of the U shape and the bimetallic element being pivotable about the limb of the element connecting the respective arms together. Other configuration of bimetallic element are however known eg. an E or V shape. Ambient compensation is achieved by virtue of the compensating bimetal (the free end of which carries the cam follower) distorting in response to changes in ambient temperature by an amount equal to the bimetallic actuator whereby the ambient position of the free end of the actuator secured to the switch contact arm is set only by the position of the cam and cam follower and is unaffected by changes in ambient temperature In a preferred embodiment, a U-shaped bimetallic element pivotally supported adjacent its connecting limb, i.e. at its side remote from the free ends of the compensating bimetal and bimetallic actuator, is arranged to as to hold the spring means of the contact arm in compression or tension against a fixed support while, at the same time, a turning moment is established which acts to deflect the bimetallic element about its pivotal support so as to urge the cam follower into engagement with the cam. The turning moment arises from the suitable mis-alignment of the pivot axis of the bimetallic element, the anchoring point of the tongue on its fixed support and the mounting point of the switch contact arm to the end of the actuator. The turning moment is established whether the switch contacts are opened or closed.

Viewed from a further aspect the invention provides an energy regulator comprising a pivotally supported bimetallic element having arms which respectively constitute an actuator associated with a heater and an ambient temperature compensating bimetal, a movable free end of the actuator being pivotally or fixedly secured to an actuation end of the contact arm of a snap-acting microswitch of the regulator, a movable switch contact being carried by the other end of such arm, the contact arm and actuator being arranged one generally above the other in face to face relation with the contact arm preferably adjacent the high expansion side of the bimetallic actuator, the microswitch comprising an over-centre spring which acts on the contact arm and which is held in a stressed condition between the contact arm and a fixed support, the spring also establishing a turning moment which deflects the bimetallic element about its pivotal support so as to maintain the engagement of a cam follower provided on the compensating bimetal with a control cam of the regulator.

Such an arrangement reduces complexity and cost as compared with known arrangements.

The bimetallic element may be supported in a housing of the regulator in any convenient manner which will allow the free end of the actuator to deflect to operate the switch, and which allows the actuator to pivot about the end thereof remote from the mounting of the switch contact arm.

In one arrangement, the bimetallic element is mounted to one end of a plate, the other end of which is fixedly supported in relation to the energy regulator housing. The contact arm, bimetallic actuator and plate are preferably arranged generally one above the other and are arranged in a general flattened Z shaped configuration when viewed side on. It is particularly preferred that the plate is flexible so as to accommodate the pivotal movement of the bimetallic element, while allowing the element to be rigidly connected to the plate, by welding or rivets for example.

In the presently preferred embodiment, however, a pivotal bearing is provided in the regulator housing. In its simplest form, this may comprise one or more aligned seats, for example V notches, into which the bimetallic element is urged preferably by the spring means of the microswitch. Preferably two bearings are provided, one at the base of each limb of the bimetallic element. The bearings may be moulded into the housing. However, to reduce the risk of creep in the bearing if the housing is thermoplastics, they may be formed in an insert of material such as copper or stainless steel. It may be sufficient to provide such a bearing only at the base of the heated limb of the bimetallic element, i.e. at the base of the actuator, since it is at this side that the heat and the forces on the bearing will be greatest.

Preferably the heating means comprises a ceramic substrate heater. Such heaters are known in the art and typically comprise a ceramic substrate upon which is provided a printed resistor heater element with electrical terminals at both ends. Preferably the heater is mounted on the bimetallic actuator, advantageously adjacent its pivoted end to maximise the deflection of the free end of the actuator.

In a particularly preferred mounting arrangement, fulcrum means are provided between the heater and the bimetallic actuator so that the heater may rack with respect to the actuator to accommodate relative movement between the heater and the bimetallic actuator as the latter deflects during heating and cooling. Preferably the bimetallic actuator is provided with a fulcrum portion which engages a portion of the heater intermediate its ends, and about which it may pivot. Preferably the fulcrum portion is in the form of a smooth arc, although it can be in the form of a shallow V for example.

The heater is resiliently biased against the pivot by spring means acting on one end of the heater. In a particularly preferred arrangement, this may be constituted by an electrical connector which at the same time makes connection with a first terminal of the heating element. Preferably the connector may be urged into contact with the heater by a cover of the regulator during assembly, although it may be so urged solely by its own resilience.

Since the heater can pivot around the fulcrum portion provided on the bimetallic actuator, a reaction surface must be provided at the end of the heater opposite to the end resiliently biased by the spring means. In a preferred arrangement a folded back tongue is formed on the bimetallic actuator under which the non-biased end of the heater engages. Preferably the tongue engages the other electrical terminal of the heater, whereby electrical energy may be supplied to the heater though the bimetallic actuator and through the contact arm carried thereby. The mounting of the heater to the bimetallic actuator is the subject of our UK Patent Application No. 9309805.1

The heater may be connected electrically in series or in parallel with the load being controlled. Where the electrical supply is conducted to the heater through the contact arm and bimetallic actuator, as described above, then if the heater is connected in series with the load, a substantial current ie. the heater current plus the load current will flow through the coupling between the contact arm and the actuator. The coupling should therefore preferably be fixed, for example a riveted coupling. However, if, as is preferred, a high resistance heater is arranged in parallel with the load, only a relatively small heater current need flow between the contact arm and the actuator and a pivotal coupling may be provided between the two.

From a third broad aspect, therefore the invention provides an energy regulator of the kind described wherein the switch contact arm is pivotally mounted on a movable free end of the bimetallic actuator.

In a particularly preferred embodiment, the pivotal connection comprises a pivotal seat formed adjacent the free end of the actuator in which the contact arm is retained. Preferably, the contact arm is resiliently biased into the seat, which may, for example, comprise one or more notches. The resilient biasing force may be provided by the stressed spring means of the switch.

From the above, it will be seen that the spring means of the switch may perform a number of functions, namely: acting as an overcentre spring for the switch; biasing the contact arm into a pivot seat on the bimetallic actuator; biasing the bimetallic actuator into a pivot seat on the housing; carrying the load current; providing the electrical contact interface pressure between the spring and the fulcrum for the load current; providing the electrical interface pressure for the heater current in the pivot between the contact actuating member and the bimetallic actuator; and biasing a cam follower of the compensating bimetal into engagement with a control cam. In the preferred embodiment, it performs all of these functions.

From a further aspect, therefore, the invention provides an energy regulator comprising a bimetallic element having arms which respectively constitute an actuator associated with a heater and an ambient temperature compensating bimetal and pivotally supported in a housing, a movable free end of the actuator being pivotally secured to an actuation end of the contact arm of a snap-acting microswitch of the regulator a movable switch contact being carried by the other end of such arm, the contact arm and actuator being arranged one generally above the other in face to face relation with the contact arm, the microswitch comprising an overcentre spring which acts on the contact arm and which is held in a stressed condition between the contact arm and a fixed support, the spring acting to bias said element into its pivotal support on the housing, to bias said contact arm into a pivot on the actuator and also establishing a turning moment which deflects the bimetallic element about its pivotal support so as to maintain the engagement of a cam follower provided on the compensating bimetal with a control cam of the regulator.

As mentioned above, in preferred embodiments, the cam follower engages with a surface of a control cam facing towards a control member. This is also a new departure from standard designs, and from a yet further aspect therefore, the invention provides an energy regulator comprising a control member having a spindle and a cam and having a bimetallic element having at least two limbs, one limb having heating means associated therewith for operating a microswitch of the regulator, and the other limb acting as an ambient compensating bimetal and provided with a cam follower for engaging a control surface of the cam, wherein the limbs of the bimetallic element are arranged around the spindle, and the cam follower engages a surface of the cam which faces the spindle.

BRIEF DESCRIPTION OF THE DRAWINGS

Some preferred embodiments of the invention will now be described, by way of example only, with reference to the accompanying drawings in which:

FIG. 5 is a view similar to FIGS. 3 and 4, but with the regulator in an 'off' condition;

FIG. 6 shows an alternative heating arrangement for the regulator of FIGS. 1 to 5;

DESCRIPTION OF THE PREFERRED EMBODIMENTS

Figure 1:
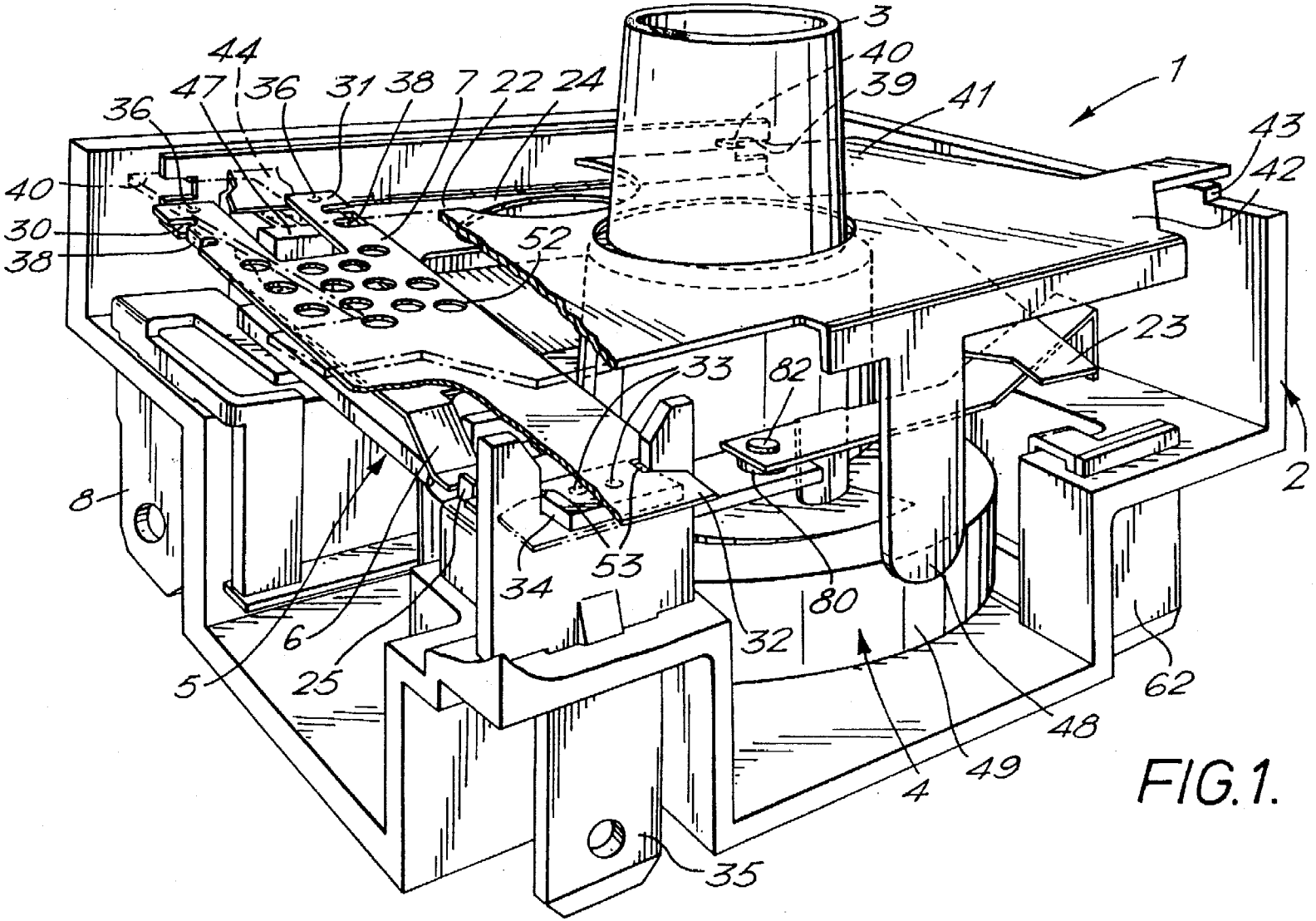
FIG. 1 is a schematic perspective view of an energy regulator in accordance with the invention.
Figure 2:
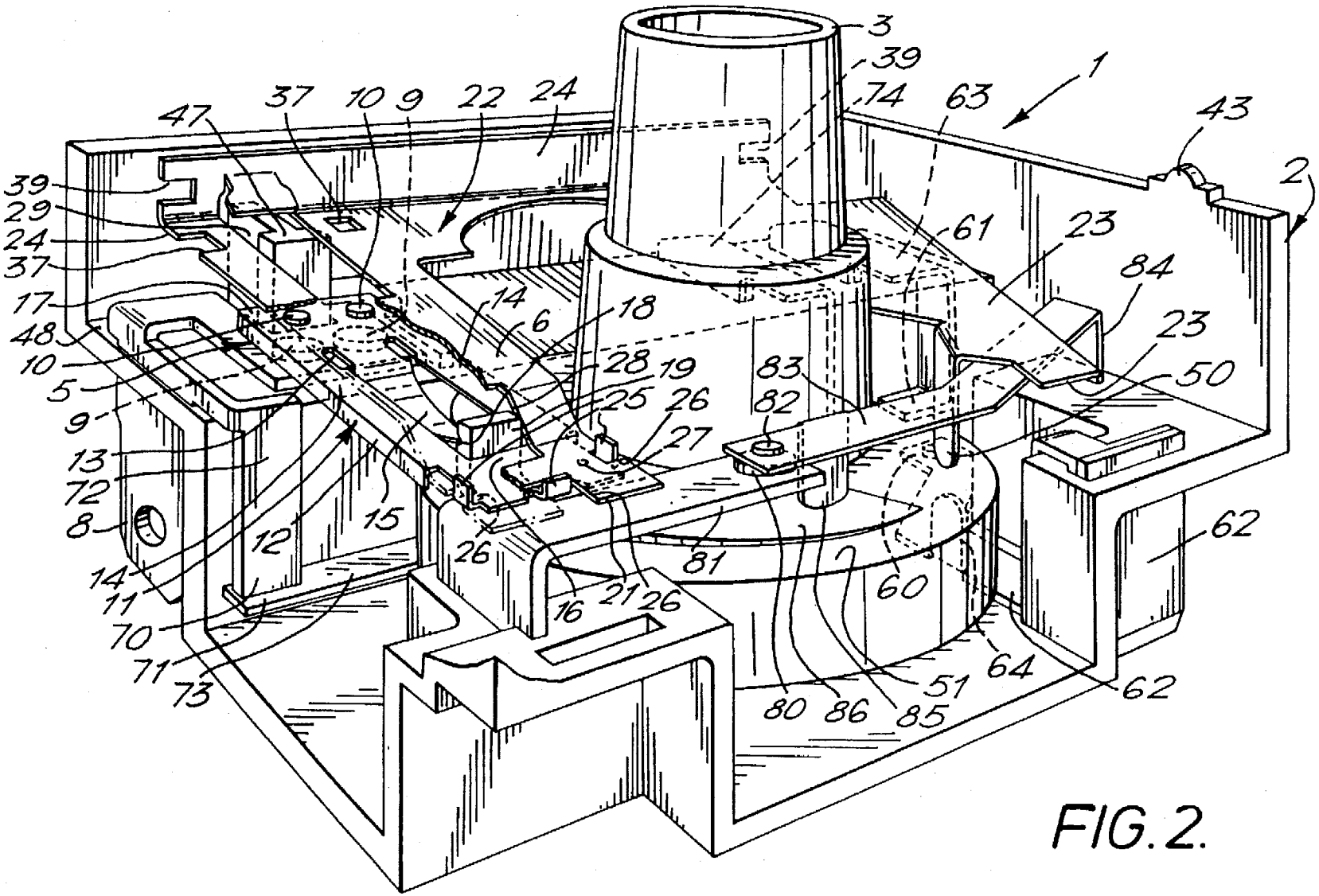
FIG. 2 is a view of the regulator of FIG. 1 with certain components removed for clarity.

Referring to FIGS. 1 and 2, an energy regulator 1 comprises a moulded housing comprising a lower moulding 2 and an upper moulding (not shown). A control knob spindle 3 is rotatably journaled in the housing and extends through an opening in the upper housing moulding, for operation by a user. The control knob spindle 3 is provided at its lower end with a cam body 4 having a number of cam surfaces, for purposes to be described below. In use, a knob (not shown) is fitted to the spindle 3.

The regulator is placed in the electrical supply circuit to the load being regulated, for example a cooker hot plate. The current supply to the load is controlled by a snap-action microswitch 5 operated by a bimetallic actuator 6 which is heated by heating means 7. The microswitch 5 is arranged in the line side supply to the load. A generally U-shaped double line-in tab 8 mounts a pair of fixed contacts 9 which co-operate with a pair of movable contacts 10 mounted on one end of a switch contact arm 11.

As can be seen most clearly from FIG. 2, the contact arm 11 is a generally rectangular member provided, along part of its length with downwardly extending lateral flanges 12 for rigidity. A generally U-shaped cut-out 13 defines a pair of side arms 14, a central tongue 15 and a cross-web 16. The central tongue 15 is bowed and acts both as a compression member and an over-centre spring and is attached at one end to the contact mounting web 17 of the arm 11, and at the other end engages in a notch 18 formed in an upwardly extending support pillar 19.

The cross-web 16 of the microswitch arm 11 is joined to a free end 21 of the bimetallic actuator 6, which itself forms one arm of a generally U-shaped bimetallic element 22. The other arm 23 of the element 22 acts as an ambient temperature compensator in a manner known in the art, and is connected to the actuator 6 by a connecting limb in the form of flanged web 24. The arm 23 carries a cam follower 50 which is biased into engagement with a cam surface 51 provided on the upper surface of the cam body 4 of the spindle 3 in a manner to be described below. Rotation of the spindle 3, causes the cam follower 50 to move up or down, which in turn causes the free end 21 of the bimetallic actuator 6 to move up or down thus varying the distance through which its free end 21 must move to cause operation of the switch.

The cross-web 16 of contact arm 11 is provided with upstanding tangs 25 which engage with complementary recesses 26 in the end 21 of the actuator 6, in order to assist in the accurate location of the two members relative to one another during assembly. The cross-web 16 is joined to the free end 21 by spot welds 27, or by a number of rivets. The latter may be easier to effect in manufacture in view of the constituent metals of the bimetallic actuator 6 which may make spot welding more difficult at this interface.

The bimetallic actuator 6 is generally rectangular and formed with a first cut-out 28 to accommodate the pillar 19 and a second cut-out 29. The end 30 of the actuator 6 adjacent the flanged web 24 is joined by spot welds 36 to one end 31 of a flexible plate member 7, the other end 32 of which is joined, by spot welds 33, to a platform 34 formed at the upper end of a line-out tab 35 fixedly mounted in the housing 2 (FIG. 1). The plate 7 overlies the actuator 6. To assist in the accurate location of the respective components, the end 30 of the actuator is provided with recesses 37 into which extend downwardly projecting tangs 38 provided on the plate 7. The microswitch arm 11, the bimetallic member 22 and the plate member 7 may thus conveniently be assembled together in a suitable jig, prior to the whole subassembly being mounted in the housing 2 by spot welding the plate 7 to the platform 34. As viewed from one side the assembly of arm 11, actuator 6 and plate 7 form a general flattened Z-shape.

The flanged web 24 of the U-shaped bimetallic element 22 is provided at its ends with slots 39 into which extend projections 40 provided at one end 41 of a plate 42 which is itself pivotally mounted in the housing on pivots 43 provided on the right hand side as illustrated. The plate 42 locates, in a direction generally perpendicular to the plane in which the bimetallic element lies, the position of the pivot axis P of the joined ends of the bimetallic element 22 and flexible plate 7. The plate 42 is itself pivotal between the position shown in FIGS. 3 and 4, when the regulator is 'on' and regulating the electrical supply to the load, and the position of FIG. 5 when the regulator is in an 'off' condition, and in which a larger 'off' gap in accordance with IEC standards of for example 4 mm is provided between the contacts 9,10.

Figure 3:
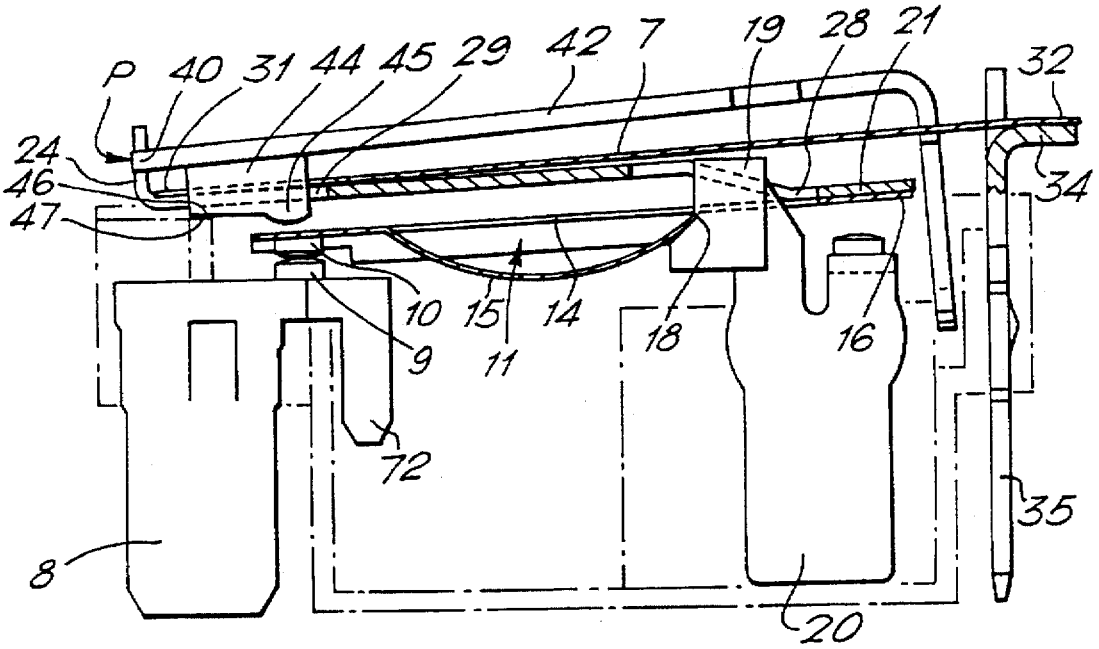
FIG. 3 is a schematic side elevation of the regulator of FIGS. 1 and 2, with certain components removed for clarity, showing the condition in which the switch contacts are closed.
Figure 4:
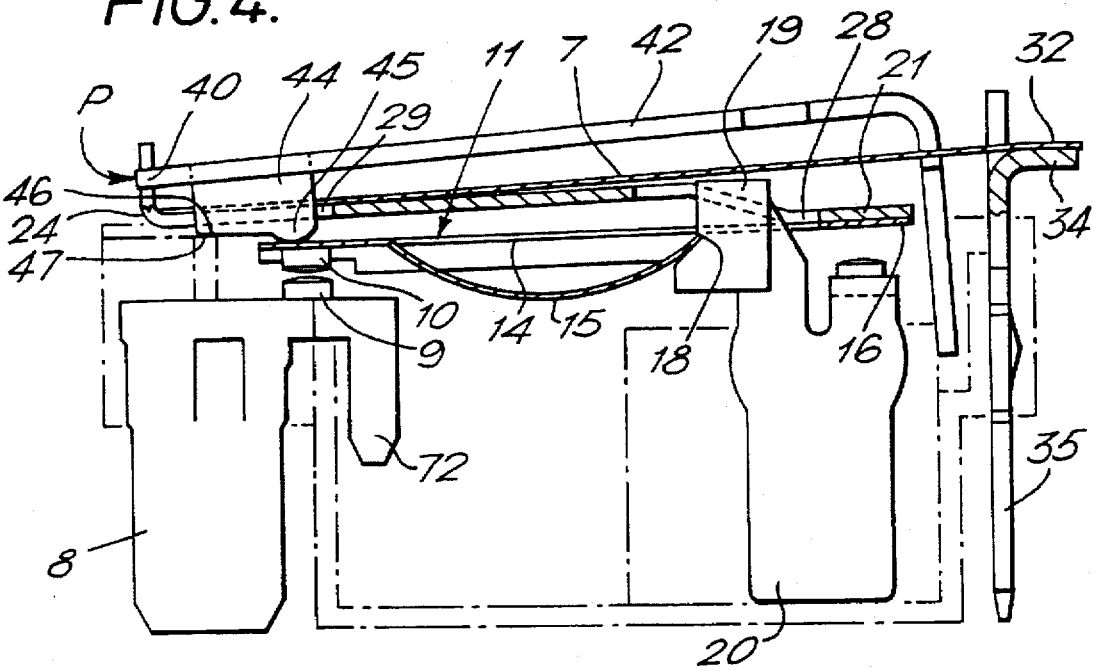
FIG. 4 is a view similar to FIG. 3, except with the regulator in the condition in which the switch contacts are open.

As can be seen most clearly from FIGS. 3–5, the plate 42 has a downward projection 44 which has a backstop 45 for the movable contacts 10 of the microswitch and an abutment portion 46 which, when the regulator is in an 'on' condition, extends through the opening 29 in the bimetallic actuator 6 to abut against a shoulder 47 provided on the housing member 2. The height of the shoulder 47 is set at a desired value above a reference surface 48 of the housing, against which surface the position of the fixed contacts 9 is also set. The arrangement is such that the gap between the open contacts 9,10 as shown in FIG. 4 is about 0.25 mm. This gap is ample to prevent arcing across the contacts and yet provide a good contact force.

The plate 42 is provided at its end remote from the projections 40, with a tongue 48 which engages with a cam surface 49 provided on the circumferential surface of the cam body 4. This tongue 48 serves to retain the plate 42 in the position shown in FIGS. 3 and 4 in a manner which will be described later.

In the embodiment of FIGS. 1–5, the flexible plate 7 acts as the sole heating means for the bimetallic actuator. To this end, the plate 7 is placed in series with the load, and when the contacts 9,10 are closed the full supply current will pass through the line in tab 8, the contacts 9,10, the microswitch arm 11, the bimetallic actuator 6, the flexible plate 7 and the line out tab 25. This is a particularly preferred arrangement in that it obviates the need for flying lead or other additional connections being made to the heating means and contact arm of the regulator. By such an arrangement, the mounting for the bimetallic actuator conducts power to the heater. The plate 7 may be made of a resistance metal, and the desired resistance of the plate 7 set for different loads by varying the size and number of holes 52 provided through it.

The flexible plate 7 is provided with positioning notches 53 which position the plate with respect to the platform 34 such that when the tongue member 15 is engaged in its notch 18, it forms a C-spring which is placed in compression. The C spring 15 will thus act as an over-centre spring for the microswitch 5, and will also place the contact arm 11 in tension, the bimetallic actuator 6 in compression and the plate member 7 in tension. A relatively thin material, for example 0.1 mm thick, may thus be used for the flexible plate 7 since buckling stresses do not need to be considered.

It will also be apparent from FIG. 3 that because the notch 18 in which the end of the C-spring 15 engages is offset from both the free end 21 and pivot axis P of the bimetallic element, turning moments will be developed in the system. More specifically, a turning moment will be developed about the pivot axis P of the bimetallic element which will tend to move the free end 21 of the actuator 6 and also the cam follower 50 downwardly, whilst at the same time the flanged web 24 of the bimetallic element 22 is itself urged upwardly against the plate 42, in the sense of FIGS. 3 to 5. The cam follower 50 will thus be biased into contact with the cam surface 51 by the spring 15 without the need for additional biasing means. The plate 42 is maintained in the position of FIGS. 3 and 4 when the regulator is 'on' by the resilience of the tongue 48 acting on the cam surface 49. To cause the plate 42 to move to the 'off' position and open the contacts 9,10 to an 'off' separation, a recess (not shown) is provided in the cam surface 49 into which the tongue 48 may spring, causing the plate 42 to pivot about the pivots 43 to the 'off' position shown in FIG. 5, solely under the moment developed by the C-spring 15.

The outer cam surface 51 is provided with means whereby as the regulator is switched off, the cam follower moves to a position causing the switch contacts 9,10 to open to the position of FIG. 4, whereafter upon further turning of the knob, the tongue 48 drops into the recess in the cam surface 49 to allow the plate 42 to pivot to the 'off' position shown in FIG. 5 to open the contacts 9,10 further.

It will be appreciated that the flexibility of the plate 7 will allow the movement of the free end 21 of the bimetallic actuator 6 during setting of the regulator via the spindle 3, by accommodating adjacent its end joined to the actuator 6, the pivoting of the bimetallic element about the pivot axis P. Flexion of the plate adjacent its other end accommodates the movement of the assembly of the bimetallic element 22, microswitch arm 11 and plate 42 when the regulator is switched 'off'.

As discussed, the plate 42, by virtue of engagement of projections 40 into slots 39 in the upstanding web 24 of the bimetallic element 22 serves to locate the position of the pivot axis P of the bimetallic element 22 in a direction generally perpendicular to the plane in which the element lies ie. in a direction approximately parallel to the direction of movement of the switch contacts 10. Otherwise, the mounting of the bimetallic element 22 within the regulator housing is by virtue of its being carried by the flexible plate 7 which serves to locate the element laterally in a free floating fashion without engaging the side walls of the housing. Accordingly, the plate 7 should have sufficient lateral stiffness to restrain twisting movement of the bimetallic element within the plane in which it lies as a result of the torque applied to the cam follower 50 during rotation of the cam.

As was mentioned above, the microswitch contacts 9–10 are provided in the line side of the electrical supply to the load. In order to provide a double pole 'off' switch, neutral contacts 60,61 are also provided on respective neutral tab members 62,63. Tab member 62 is resilient and provided with an upstanding lug 64 which engages with the under surface of cam body 4, that cam surface having a ramp, or tooth, not shown, arranged in such a position that when the control knob is turned to an 'off' position, it pushes the lug 64 downwardly to open the contacts 60,61, as shown.

Furthermore, to indicate that the regulator is on, a set of neon contacts 70,71 is provided. The contact 70 may be provided in an extension 72 of the line-in tab and the contact 71 on a resilient member 73 connected to a neon tab 74. The member 73 is provided with an upstanding lug (not shown) which engages the lower surface of the cam body 4. As in the case of the neutral switch, the cam body 4 is provided with a ramp or tooth which deflects the lug when the knob is rotated to an 'off' position, so extinguishing a neon connected between the neon and line-in tabs 74,8.

The regulator described in FIGS. 1–5 also comprises means for supplying energy to a two-part load such as a split-grill. A first, fixed, contact 80 is mounted on an extension 81 of the line-out terminal 35, and a second, movable contact 82 mounted on a resilient member 83 connected to a secondary line-out terminal 84. The resilient member 83 has a bent down cam follower 85 which engages an inner cam surface 86 on the upper surface of the cam body 4. When the contacts 80,81 are closed, electrical energy is supplied to both parts of the load, through the respective line-out terminals 35 and 84. When power is to be supplied to owe part of the load only, the knob is twisted to such a position that the cam follower 85 rides up the cam surface 86 to open the contacts 80,81, whereby power is supplied only through the main line-out terminal 35.

In operation of the device, the desired power setting of the load is set by turning a knob connected to spindle 3 to a suitable position against a scale, not shown. Through deflection of the cam follower 50, this sets an initial position of the free end 21 of the bimetallic actuator 6. The current supplied to the load will flow through the microswitch arm 11, bimetallic actuator 6 and flexible plate 7. The flexible plate 7 will be heated by the current flowing through it (as indeed will the actuator 6 itself), the heat generated acting on the bimetallic actuator 6, causing its free end 21 gradually to deflect. When sufficient heat has been supplied, the free end 21 of the actuator 6 will move to the point where the C-spring 15 moves overcentre causing the contacts 9,10 to open with a snap-action. This interrupts the electrical supply to the load, and thus to the plate 7. The bimetallic actuator 6 will then cool to the point at which the C-spring member 15 moves over-centre in the other direction to close the contacts 9,10 with a snap action to reconnect the supply to the load. The cycle can be varied by turning the knob 3 and thus changing the initial position of the free end 21 of the actuator 6 by pivoting the actuator about its pivot axis.

When it is desired to discontinue the supply to the load, the regulator is turned to its 'off' position, at which point the plate 42 pivot under the force of the spring 15 to allow the gap between the contacts 9,10 to increase as described above, the neutral contacts 60,61 are pushed apart to give a double-pole disconnection, and the neon contacts 70,71 broken to extinguish the neon 'on' indicator.

The embodiment of FIGS. 1–5 describes an arrangement in which the flexible plate 7 is in series with the load and acts as the heater for the bimetallic actuator. While such an arrangement is particularly preferred in that it obviates the need for any flying leads to, and a separate mounting for the heating means, when a single regulator is intended to be used to control a number of loads of different resistances, such a series arrangement is not suitable. Accordingly in an alternative embodiment a heater is provided which is placed in parallel with the load. One such heater is shown in FIG. 6. In this heater, a flexible plate 100 having the same general shape as that plate 7 mounts a high resistance ceramic heater 101 on its upper surface. Heat is transferred to the bimetallic actuator through the plate 7. The plate 7 is welded to the pillar 34 and to the bimetallic actuator 6 in the same manner as in the earlier embodiment. The heater 101 is of a type known in the art, comprising a ceramic substrate 102 mounting a printed resist heater 103. Connections 104,105 are provided at both ends of the heater 103.

Current is supplied to the heater via spring clips 106 provided on the plate 100, which also retain the heater on the plate 100, and a flying lead 107 leads to the neutral terminal of the regulator, such that the heater 103 will be connected in parallel with the load. The plate 100 in this embodiment is made of a lower resistance material than in the previous embodiment, so that the plate 100 itself contributes relatively little heating effect. For example, in one embodiment, the heater 103 may have a resistance of 11,000 ohms, and the plate 100 a resistance of 5 milli ohms and the load a resistance of 40 ohms. In this embodiment, despite the mounting of the heater, the plate is still sufficiently flexible adjacent its ends to accommodate the pivotal movement of the actuator about the axis P during setting of the ambient position, and about pivots 43 upon movement of the plate 42 between the "on" and "off" positions.

It will be appreciated that certain features of the above embodiments may easily be omitted to simplify the design and thus reduce the production cost. For example, if single pole switching is required only, then the neutral side switch may be dispensed with. Furthermore, if it is not necessary to provide the I.E.C. 3 mm gap between the contacts 9,10 of the microswitch 5, when the regulator is switched 'off', then the pivotable plate 42 may be dispensed with, and the joined ends of the bimetallic actuator and flexible plate 7 pivotally located by means on the housing 2. A separate 'off' switch may then be provided for the load. The split-load facility and neon indicator facility may also be omitted if desired.

Figure 7:
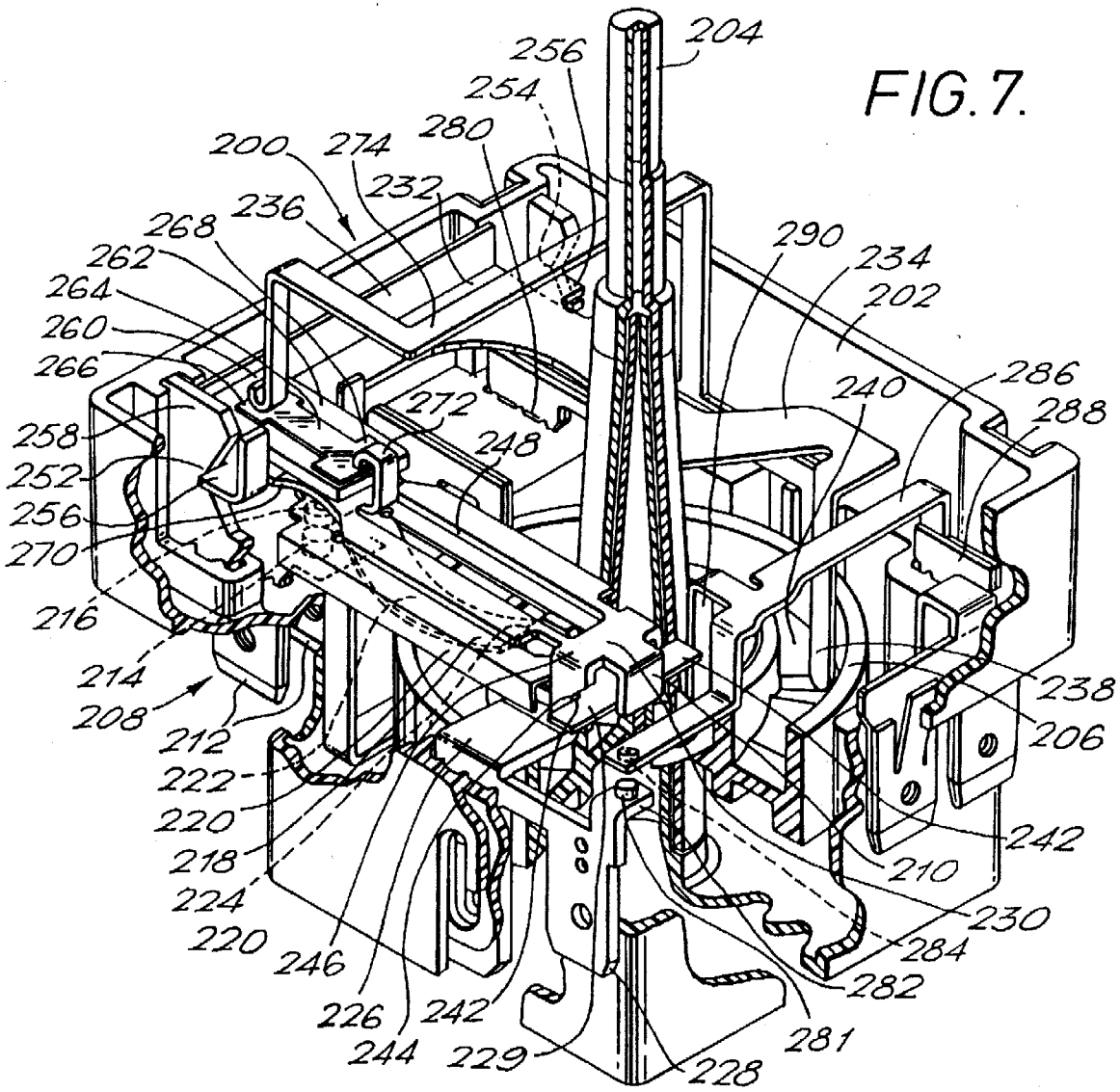
FIG. 7 is a perspective view of a further embodiment of the invention, with certain parts cut away for clarity.
Figure 8:
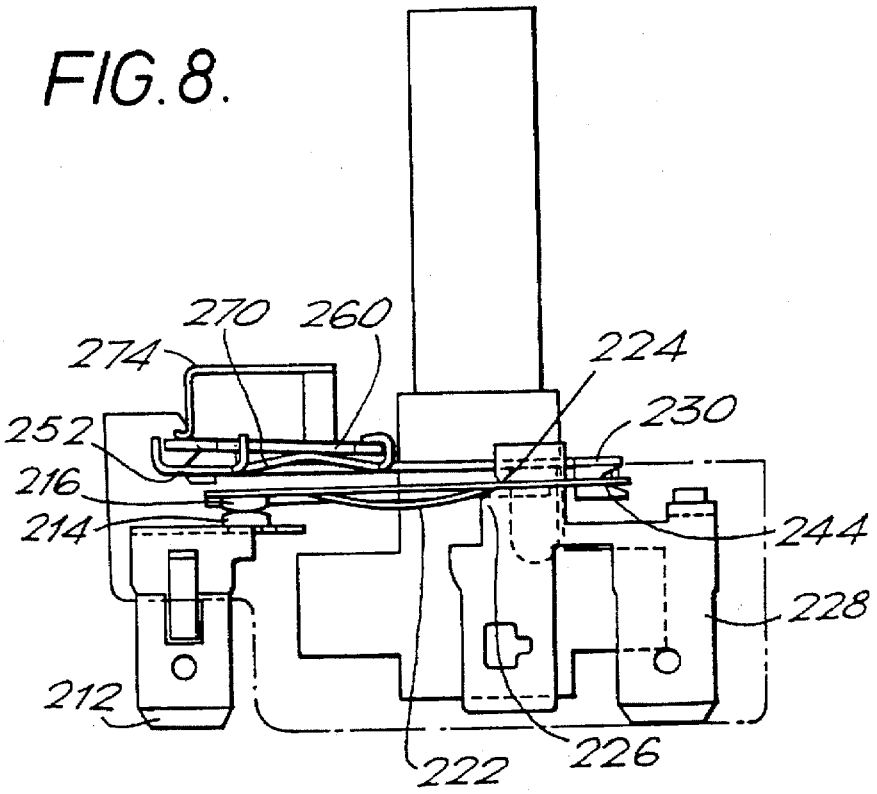
FIG. 8 is a schematic side elevation of certain parts of the regulator of FIG. 7 showing the condition in which the switch contacts are closed.
Figure 9:
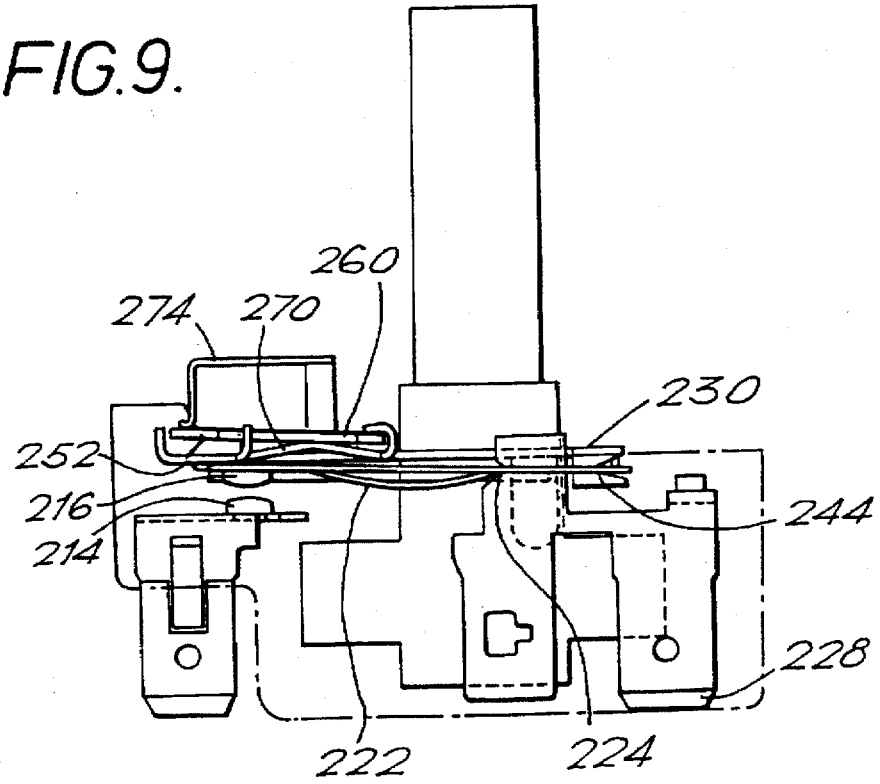
FIG. 9 is a schematic side elevation of certain parts of the regulator of FIG. 7 showing the condition in which the switch contacts are open.

A further embodiment of the invention will now be described with reference to FIGS. 7 to 9.

The energy regulator 200 of this embodiment also comprises a moulded housing comprising a lower moulding 202 and an upper moulding (not shown). A control knob spindle 204 is rotatably journaled in the housing and extends through an opening in the upper housing moulding, for operation by a user. The control knob spindle 204 is provided at its lower end with a cam body 206 having a number of cam surfaces, for purposes to be described below. In use, a knob (not shown) is fitted to the spindle 204.

The regulator is placed in the electrical supply circuit to the load being regulated, for example a cooker hot plate. The current supply to the load is controlled by a snap-action microswitch 208 operated by a bimetallic actuator 210 which is heated by heater 260. The microswitch 208 is arranged in the line side of the supply to the load. A generally U-shaped double line-in tab 212 mounts a fixed contact 214 which co-operates with a movable contact 216 mounted on one end of a switch contact arm 218.

The contact arm 218 is a generally rectangular member provided, along part of its length, with downwardly extending lateral flanges 220 for rigidity. A generally U-shaped cut-out in the contact arm 218 releases a central tongue 222 which is bowed and acts both as a compression member and an over-centre spring. It is integral at one end with the portion of the contact arm 218 mounting the contact 216 and at the other end engages in a notch 224 formed in an upwardly extending support pillar 226. The pillar 226 is an upper portion of a line out tab 228.

The actuating end 229 of the microswitch arm 218 remote from the contact 216 is coupled to a free end 230 of the bimetallic actuator 210, which itself forms one arm of a generally U-shaped bimetallic element 232. The other arm 234 of the element 232 acts as an ambient temperature compensator in a manner known in the art, and is connected to the actuator 210 by a connecting limb in the form of flanged web 236. The arm 234 carries a cam follower 238 which is biased into engagement with a first cam surface 240 provided on the upper surface of the cam body 206 of the spindle 204 in a manner to be described below. Rotation of the spindle 204 causes the cam follower 238 to move up or down, which in turn causes the free end 230 of the bimetallic actuator 210 to move up or down thus varying the distance through which its free end 230 must move to cause operation of the switch.

The cross-web 229 of contact arm 218 is provided with laterally extending lugs 242 which engage with notches 244 formed in downturned end portions 246 of the actuator 210 to provide a pivotal connection. The lugs 242 are biased into the notches 244 by the spring tongue 222, which places the contact arm 218 in tension.

The bimetallic actuator 210 is generally rectangular and formed with a rectangular cut-out 248 which allows access to the tongue 222 during assembly, so that the tongue may be pushed into the notch 224.

The bimetallic element 232 is pivotally mounted in V notches 252,254 provided in the housing 202 by lugs 256. The lugs 256 are biased into the notches 252,254 by the spring tongue 222, which via the actuating arm 218 places the bimetallic actuator 210 in compression. The notch 254 adjacent the base of the compensating limb 234 is moulded into the housing 202. However, the notch 252 is formed in a stainless steel or copper insert 258. This is preferred since the adjacent region of the actuator 210 will become quite hot in use, and also since the reaction to the biasing force of the spring tongue 222 at this point will be greater than at the other notch 254. This avoids potential problems of creep in the thermoplastics housing.

As mentioned above, the bimetallic actuator 210 is heated by a ceramic substrate heater 260 mounted at the end of the actuator 210 adjacent the pivotal mounting. The heater comprises a ceramic substrate 262, on which is printed a resistor heating element 264. First and second electrical terminals 266,268 are provided at opposite ends of the element 264. The heater 260 rests on an arched fulcrum 270 formed across a root portion of the actuator 210. The second terminal 268 of the heater 260 engages under a substantially rigid tongue 272 released and folded back from the cut out 248 of the actuator 210. To facilitate this engagement, the second terminal 268 is located adjacent the edge of the heater 260. The tongue 272 locates the heater 260 longitudinally in one direction on the actuator 210. The first terminal 266 of the heater is contacted and biased downwardly by a spring arm 274. The arm 274 is biased downwardly under its own resilience or by the upper moulding of the housing when the latter is assembled. The downward biasing force of the arm 274 not only ensures a good electrical connection with the first terminal 266, but also causes the heater to rock on the fulcrum 270, so that the second terminal 268 of the heater 260 engages with the tongue 272.

The resilience of the spring arm 274 accommodates movement between the heater 260 and the bimetallic actuator 210 as the latter heats up and cools down. The other end of the arm 274 is formed integrally with a tab 280 extending through the housing 202 for connection into the heater supply circuit. The arm also urges the heater into good thermal contact with the bimetallic actuator 210.

The electrical circuit to the heater 240 is completed through the tongue 222, the bimetallic actuator 210, the contact arm 218, the contacts 214,216 and the line in tab 212. This circuit is in parallel with the supply to the load being controlled, which passes through the line in tab 212, the contacts 214, 216, the central tongue 22 of the actuator arm 218, the fulcrum 229 and the line out tab 230.

Operation of the regulator of this embodiment will now be described. The desired power setting of the load is set by turning a knob connected to spindle 204 to a suitable position against a scale, not shown. Through deflection of the cam follower 238, this sets an initial position of the free end 230 of the bimetallic actuator 210. The regulator is shown in FIG. 8 in the condition where the contacts 214,216 are closed and thus power is being supplied both to the load and to the heater 260 via the circuits described above. As the heater heats the bimetallic actuator 210, the free end 230 of the latter deflects to the point where the spring tongue 222 moves over-centre with respect to the line extending between the pivots 244 on the bimetal and the fulcrum 224 on the post 228, at which point the actuating arm 218 moves upwardly (in the sense of FIG. 8) with a snap action, to break the contacts 214,216, as shown in FIG. 9.

With the contacts 214,216 opened, both the power supply to the load and to the heater 260 is interrupted.

The heater 260 and bimetallic actuator 210 then cool to the point where the spring tongue 222 moves over-centre in the other direction to close the contacts 214,216 with a snap action to reconnect the supply to the load and to the heater 260. The cycle can be varied by turning the spindle 204 and thus changing the initial position of the free end 230 of the bimetallic actuator 210.

The regulator also comprises means for supplying energy to a two-part load such as a split grill. A first, fixed, contact 280 is mounted on an extension 282 of the line-out terminal 228, and a second, movable contact 284 mounted on a resilient electrically conductive member 286 connected to a secondary line-out terminal 288. The resilient member 286 has a bent down cam follower 290 which engages an inner cam surface on the upper surface of the cam body 206. When the contacts 280,284 are closed, electrical energy is supplied to both parts of the load, through the respective line-out terminals 228 and 288. When power is to be supplied to one part of the load only, the knob is twisted to such a position that the cam follower 286 rides up the inner cam surface t0 open the contacts 280, 284, whereby power is supplied only through the main line-out terminal 228.

As in the earlier embodiments, an on-off switch (not shown) may be provided in the neutral side of the supply.

We claim:

1. An energy regulator for regulating a supply of electrical energy to a load, the energy regulator comprising:

a housing;

a bimetallic actuator having two ends, the bimetallic actuator being mounted at one end thereof in the housing;

an electrically energizable heater associated with the bimetallic actuator, the heater, in use, being connected electrically with the load;

a microswitch comprising a fixed electrical contact, a switch contact arm, and a movable electrical contact mounted on an end of the switch contact arm, the switch contact arm having two ends and being mounted at an end thereof remote from the movable contact to a free end of the bimetallic actuator remote from the end of the bimetallic actuator mounted in the housing such that the switch contact arm is arranged in a generally face to face relationship with the bimetallic actuator with the switch contact arm and the bimetallic actuator overlying each other, wherein deformation of the bimetallic actuator causes displacement of the free end of the bimetallic actuator, which displacement is transmitted to the end of the switch contact arm mounted thereto; and a stressed spring for moving the switch contact arm with a snap action between an open position in which the fixed electrical contact and the movable electrical contact are open and a closed position in which the fixed electrical contact and the movable electrical contact are closed, the arrangement being such that, in use, the heater heats the bimetallic actuator, causing it to deform to the point where it causes snap-movement of the contact arm to open the switch contacts and interrupt the power supply to both the load and the heater whereafter the bimetallic actuator then cools and deforms in the opposite direction to the point where the contact arm undergoes reverse snap-action to close the contacts once more, the energy regulator further comprising:

an ambient compensating bimetal;

a rotatable cam surface;

a control member operatively coupled to the rotatable cam surface; and a cam follower engaging the cam surface, movement of the cam follower in response to rotation of the control member and cam surface being effective to vary the distance through which the free end of the bimetallic actuator must deflect under the heating effect of the heater to cause the switch contact arm to operate to open the contacts.

2. An energy regulator as claimed in claim 1 wherein the contact arm is pivotally mounted on the free end of the bimetallic actuator.

3. An energy regulator as claimed in claim 2 further comprising a pivotal seat provided on the bimetallic actuator into which the contact arm is resiliently biased by the stressed spring of the microswitch.

4. An energy regulator as claimed in claim 1 wherein the bimetallic actuator is pivotally supported with respect to the regulator housing.

5. An energy regulator as claimed in claim 4 wherein the bimetallic actuator is biased into a pivotal support by the stressed spring of the microswitch.

6. An energy regulator as claimed in claim 5 wherein the pivotal support comprises a metallic insert located in the housing.

7. An energy regulator as claimed in claim 5 wherein the pivotal support comprises a V notch.

8. An energy regulator as claimed in claim 1 wherein the spring comprises a C-spring extending between the switch contact arm and a reaction support.

9. An energy regulator as claimed in claim 8 wherein the contact arm comprises an elongate blade having a U-shaped cut-out defining a tongue intermediate two side arms, the tongue being bowed in use to form the C-spring.

10. An energy regulator as claimed in claim 1 wherein the stressed spring of the microswitch further acts to bias the cam follower into engagement with the cam surface.

11. An energy regulator as claimed in claim 1 wherein the cam follower is provided on the compensating bimetal.

12. An energy regulator as claimed in claim 11 wherein the bimetallic actuator and the compensating bimetal form respective arms of a generally U-shaped element.

13. An energy regulator as claimed in claim 12 wherein the U-shaped element is pivotally mounted, the stressed spring of the microswitch acting to establish a turning moment which deflects the element about its pivotal support to bias the cam follower into engagement with the control cam surface.

14. An energy regulator as claimed in claim 12 wherein the bimetallic actuator and compensating bimetal are arranged around the sides of a spindle extending from the cam surface and facing the cam surface.

15. An energy regulator as claimed in claim 1 wherein the heater comprises a ceramic substrate heater.

16. An energy regulator as claimed in claim 15 wherein a fulcrum is provided between the heater and the bimetallic actuator so that the heater may rock with respect to the bimetallic actuator to accommodate relative movement between the heater and the bimetallic actuator as the latter deflects during heating and cooling.

17. An energy regulator as claimed in claim 16 wherein the bimetallic actuator is provided with a fulcrum portion which engages a portion of the heater intermediate its ends, and about which it may pivot, the heater being resiliently biased against the bimetallic actuator by a spring acting on one end of the heater, and a reaction surface being provided at the end of the heater opposite to the end resiliently biased by the spring.

18. An energy regulator as claimed in claim 17 wherein the spring is constituted by an electrical connector which at the same time makes connection with a first terminal of the heater.

19. An energy regulator as claimed in claim 1 wherein the bimetallic actuator is in electrical connection with the switch contact arm.

20. An energy regulator as claimed in claim 19 wherein the bimetallic actuator conducts electrical energy to the switch contact arm.

21. An energy regulator as claimed in claim 1 wherein the switch contact arm is mounted directly on the bimetallic actuator.

22. An energy regulator comprising a bimetallic actuator and a snap-acting microswitch associated therewith, said regulator comprising a switch actuating member carried by a movable portion of the bimetallic actuator, wherein said actuating member comprises a switch contact arm mounted, at its end remote from the contact, on the free end of the bimetallic actuator, and the switch contact arm and the bimetallic actuator are arranged in a generally face to face relationship, such that the actuator overlies the contact arm and is secured thereto at one end.

23. An energy regulator as claimed in claim 22 comprising control means for adjusting the operating cycle of the microswitch and comprising a rotatable cam surface operatively coupled to a control member and a cam follower engaging the cam surface and being coupled to the bimetallic actuator via a compensating bimetal.

24. An energy regulator as claimed in claim 23 wherein the cam follower engages with a surface of the cam which faces towards the control member.

25. An energy regulator as claimed in claim 23 wherein the spring means of the microswitch acts to bias the cam follower into engagement with the cam surface.

26. An energy regulator comprising a pivotally supported bimetallic element having arms which respectively constitute an actuator associated with a heater and an ambient temperature compensating bimetal, a movable free end of the actuator being secured to an actuation end of a contact arm of a snap-acting micro-switch of the regulator, a movable switch contact being carried by the other end of such arm, the contact arm and actuator being arranged one generally above the other in face to face relation, the micro-switch comprising an overcentre spring which acts on the contact arm and which is held in a stressed condition between the contact arm and a fixed support, the spring also establishing a turning moment which deflects the bimetallic element about its pivotal support so as to maintain the engagement of a cam follower provided on the compensating bimetal with a control cam of the regulator.

27. An energy regulator as claimed in claim 8 wherein the bimetallic actuator is supported on a pivotal bearing of the regulator housing.

28. An energy regulator as claimed in claim 27 wherein said pivotal bearing comprises a metallic insert located in the housing.

29. An energy regulator as claimed in claim 26 wherein the heating means comprises a ceramic substrate heater.

30. An energy regulator as claimed in claim 29 wherein the heater is mounted on the bimetallic actuator, and fulcrum means are provided between the heater and the bimetallic actuator so that the heater may rock with respect to the actuator to accommodate relative movement between the heater and the bimetallic actuator as the latter deflects during heating and cooling.

31. An energy regulator as claimed in claim 30 wherein the said bimetallic actuator is provided with a fulcrum portion which engages a portion of the heater intermediate its ends, and about which it may pivot, the heater being resiliently biased against the actuator by spring means acting on one end of the heater, and a reaction surface being provided at the end of the heater opposite to the end resiliently biased by the spring means.

32. An energy regulator as claimed in claim 31 wherein said spring means is constituted by an electrical connector which at the same time makes connection with a first terminal of the heating element.

33. An energy regulator as claimed in claim 8 wherein said switch actuating member or contact arm is pivotally mounted on the bimetallic actuator.

34. An energy regulator as claimed in claim 33 further comprising a pivotal seat provided on the actuator into which the bimetallic actuator is resiliently biased.

35. An energy regulator as claimed in claim 34 wherein the resilient biasing force is provided by the stressed spring means of the microswitch.

36. An energy regulator comprising a bimetallic element having arms which respectively constitute an actuator associated with a heater and an ambient temperature compensating bimetal, the bimetallic element being pivotally supported in a housing, a movable free end of the actuator being pivotally secured to an actuation end of a contact arm of a snap-acting microswitch of the regulator, a movable switch contact being carried by the other end of such arm, the contact arm and actuator being arranged one generally above the other in face to face relation, the microswitch comprising an overcentre spring which acts on the contact arm and which is held in a stressed condition between the contact arm and a fixed support, the spring acting to bias said element into its pivotal support on the housing, to bias said contact arm into a pivot on the actuator and also establishing a turning moment which deflects the bimetallic element about its pivotal support so as to maintain the engagement of a cam follower provided on the compensating bimetal with a control cam of the regulator.

37. An energy regulator comprising a control member having a spindle and a control cam provided at one end of the spindle, and having a bimetallic element having at least two limbs, one limb acting as a bimetallic actuator and having heating means associated therewith for operating a micro-switch of the regulator, and the other limb acting as an ambient compensating bimetal and provided with a cam follower for engaging a control surface of the cam, wherein the limbs of the bimetallic element are arranged around the spindle, and the control surface of the cam faces in the direction of the spindle.

38. An energy regulator as claimed in claim 37 comprising a snap action microswitch having a switch actuating member arranged in a generally face to face relationship with the one limb of the bimetallic element, such that the limb overlies the actuating member.

39. An energy regulator as claimed in claim 38 wherein the switch actuating member is arranged between the one limb and the cam surface.

40. An energy regulator as claimed in claim 37 wherein said bimetallic element is U-shaped.

41. An energy regulator as claimed in claim 37 wherein the bimetallic element is pivotally mounted in a housing of the regulator.

42. An energy regulator as claimed in claim 41 wherein the bimetallic element is pivotally mounted on a flexible plate.

43. An energy regulator as claimed in claim 41 wherein the bimetallic element is mounted in a pivotal bearing.

44. An energy regulator as claimed in claim 43 wherein the pivotal bearing comprises a metallic insert located in the housing.

45. An energy regulator as claimed in claim 37 wherein the heater comprises a ceramic substrate heater.

46. An energy regulator as claimed in claim 45 wherein the heater is mounted on the one limb of the bimetallic element, and a fulcrum is provided between the heater and the one limb so that the heater may rock with respect thereto to accommodate relative movement therebetween as the one limb deflects during heating and cooling.

47. An energy regulator as claimed in claim 46 wherein the one limb is provided with a fulcrum portion which engages a portion of the heater intermediate its ends, and about which it may pivot, the heater being resiliently biased against the bimetallic actuator by a spring acting on one end of the heater, and a reaction surface being provided at the end of the heater opposite to the end resiliently biased by the spring.

48. An energy regulator as claimed in claim 47 wherein the spring is constituted by an electrical connector which at the same time makes connection with a first terminal of the heater.

* * * * *